United States Patent [19]

Hermanson

[11] 4,182,352

[45] Jan. 8, 1980

[54] FOLDABLE PAPERBOARD UMBRELLA

[76] Inventor: Terry Hermanson, c/o Mr. Christmas Inc., 41 Madison Ave., New York, N.Y. 10010

[21] Appl. No.: 954,153

[22] Filed: Oct. 24, 1978

[51] Int. Cl.[2] ..... A45B 19/00; A45B 13/00

[52] U.S. Cl. ..... 135/19.5; 135/20 R

[58] Field of Search ..... 135/19.5, 20, 25, 33 R

[56] References Cited

U.S. PATENT DOCUMENTS

| | | | |
|---|---|---|---|
| 1,464,830 | 8/1923 | Reid | 135/20 R |
| 1,752,820 | 4/1930 | Timblin | 135/19.5 |
| 1,752,821 | 4/1930 | Timblin | 135/19.5 |
| 1,924,427 | 8/1933 | Williams | 135/20 R |
| 3,205,904 | 9/1965 | Kreachbaum | 135/19.5 |

*Primary Examiner*—Reinaldo P. Machado
*Attorney, Agent, or Firm*—Karl W. Flocks

[57] ABSTRACT

An umbrella of paperboard or like material comprising a plurality of radially inwardly disposed panels; a plurality of radially outwardly disposed panels; and first and second operating units; the radially inwardly disposed panels each being generally in the form of isosceles triangles in side-by-side relationship with bases forming a theoretical circumscribing circle and opposite vertices at the center of such circle, the inwardly disposed panels including first and second main panels situated in diametrically opposed positions, a first series and a second series of secondary panels extending from opposite sides of the first main panel to the second main panel, the first and second main panels being foldably connected to adjacent secondary panels on opposite sides thereof, the secondary panels each being bisected into substantially right triangular sections by a hinge extending from the vertex at the center of the center of the theoretical circle to the base opposite therefrom, each secondary panel being foldable along the respective hinge thereof whereby the substantially right triangular sections may be folded together to close the umbrella, each secondary panel further being foldably connected to at least one other secondary panel along a further fold line; a plurality of radially outwardly disposed panels in generally trapezoidal form, in side-by-side relationship and having radially inwardly disposed minor bases and radially outwardly disposed major bases, one generally trapezoidal panel being a first main trapezoidal panel, another generally trapezoidal panel being a second main trapezoidal panel situated in a position diametrically opposed to the first main trapezoidal panel, a first series and a second series of secondary trapezoidal panels extending from opposite sides of the first main trapezoidal panel to the second main trapezoidal panel.

11 Claims, 15 Drawing Figures

FOLDABLE PAPERBOARD UMBRELLA

BACKGROUND OF THE INVENTION

1. Field of the Invention

This invention relates to disposable unbrellas and more particularly to an umbrella of the type made of inexpensive material such as corrugated board or other planar material such as cardboard and which may be folded to a compact flat condition, when closed, so that it may be conveniently stored or arranged in a stack and dispensed from an article dispensing machine in the manner that newspapers and shopping bags are dispensed.

Prior to the instant invention, there have been attempts at producing disposable unbrellas from simple planar materials, but such prior devices have not achieved acceptance in the trade and by the consumer because they are awkward to use, or they are too expensive to produce.

The umbrella in accordance with the invention can be made on automatic paper handling machines having gluing equipment and folding mechanism. The parts or elements of the umbrella are simply die cut. The operation of the disposable umbrella is simple and foolproof. The umbrella is easy to hold when open, easy to store when closed, and operates in a manner in which the consumer may expect it to operate.

2. Description of the Prior Art

Of the prior art known to applicant, U.S. Pat. No. 1,464,830, granted to Reid et al and other art in Class 135, Subclasses 19.5 and 20, are believed to constitute the most relevant prior art. To applicant's knowledge, only the Reid et al patent mentioned above discloses structure resembling the structure disclosed in the present application. That resemblance resides in the pleated construction of the canopy members of Reid et al and that of applicant, but there the resemblance ends in that the operating handles, as well as other features of the two structures, are so different that the respective operations thereof are radically different and obviously distinguishable from each other. In Reid et al, portions of the canopy and/or canopy support are connected to a slide or ferrule extending around the handle for sliding operation therealong. The umbrella construction according to the present invention includes neither a slide (or ferrule) nor a handle over which such a member may be slid in operation.

SUMMARY OF THE INVENTION

The present invention relates to a new and improved disposable umbrella of corrugated paperboard or like planar material such as cardboard which may be folded to a compact flat condition.

It is also an object of the present invention to provide a new and improved umbrella which is simple to manufacture and to operate.

It is a further object of the present invention to provide an umbrella with a new and improved canopy construction which is readily erected without any sliding parts.

Moreover, it is an object of the present invention to provide an umbrella with a new and improved operating handle without sliding parts associated therewith.

BRIEF DESCRIPTION OF THE DRAWINGS

The present invention will be readily and clearly understood by the reader upon review of the accompanying drawings in which.

DETAILED DESCRIPTION OF THE INVENTION

Figure 1:
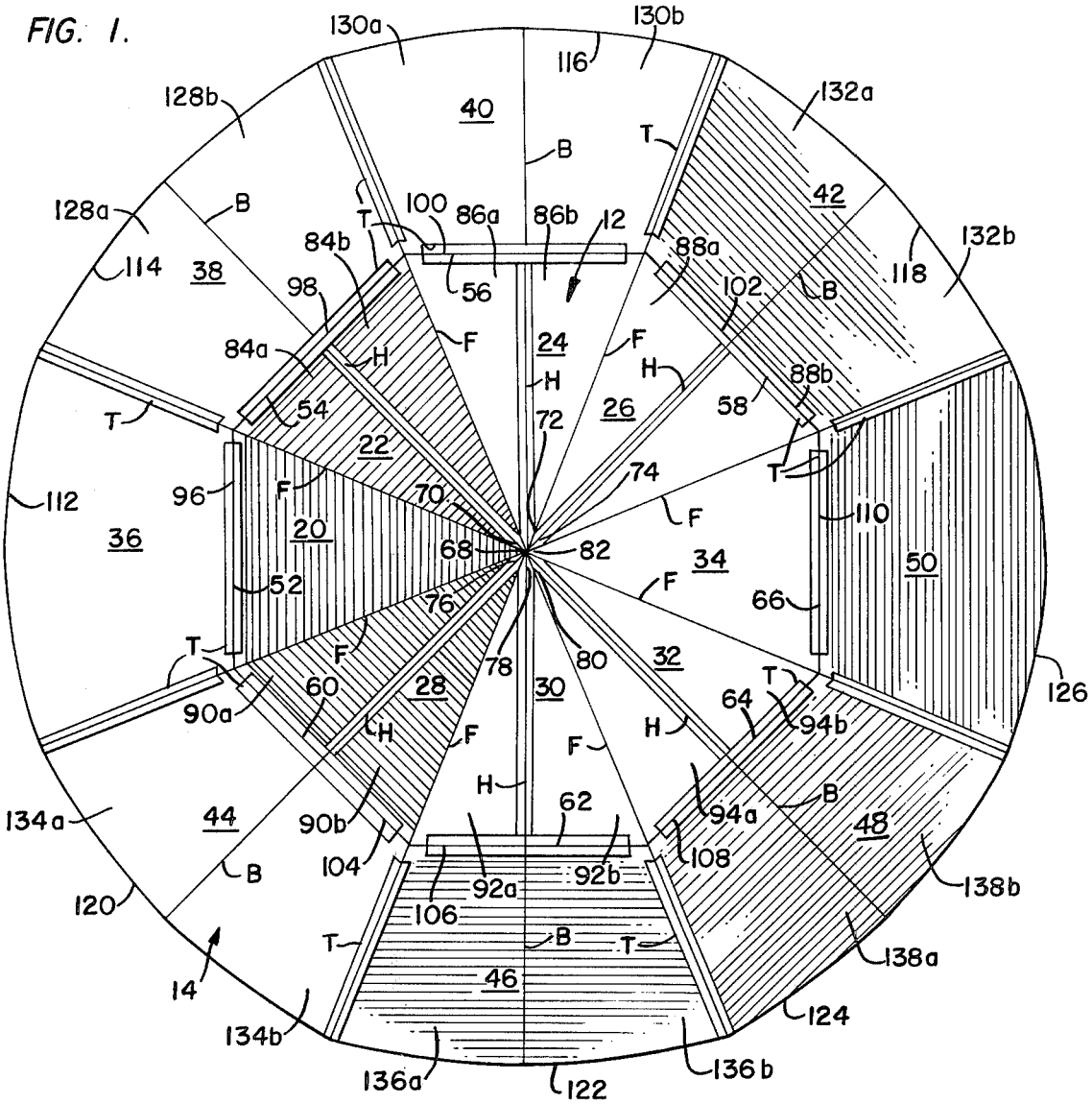
FIG. 1 represents a top plan view of the umbrella of the present invention is erected condition for use.
Figure 2:
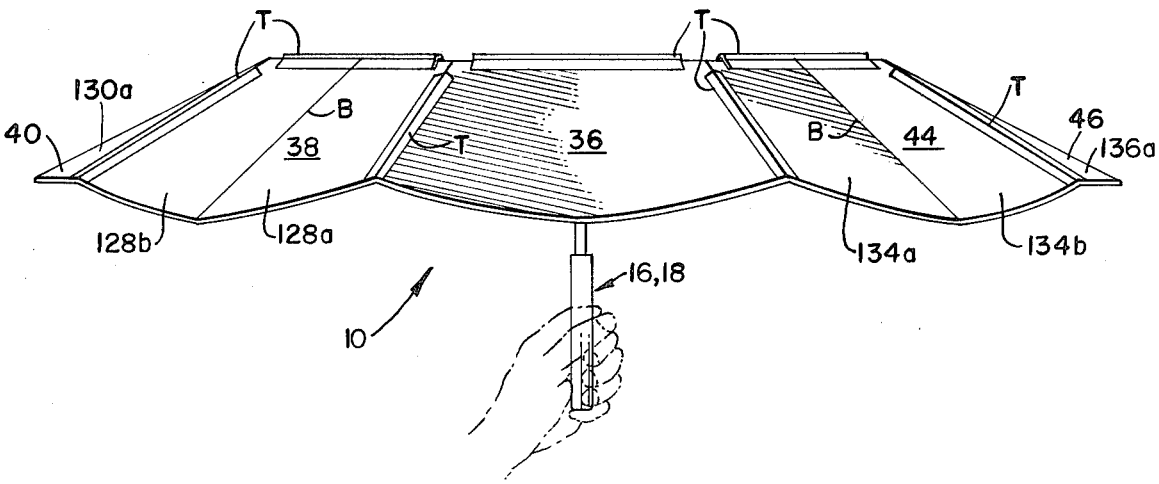
FIG. 2 is a side elevational view of the umbrella of FIG. 1 in erected condition.
Figure 3:
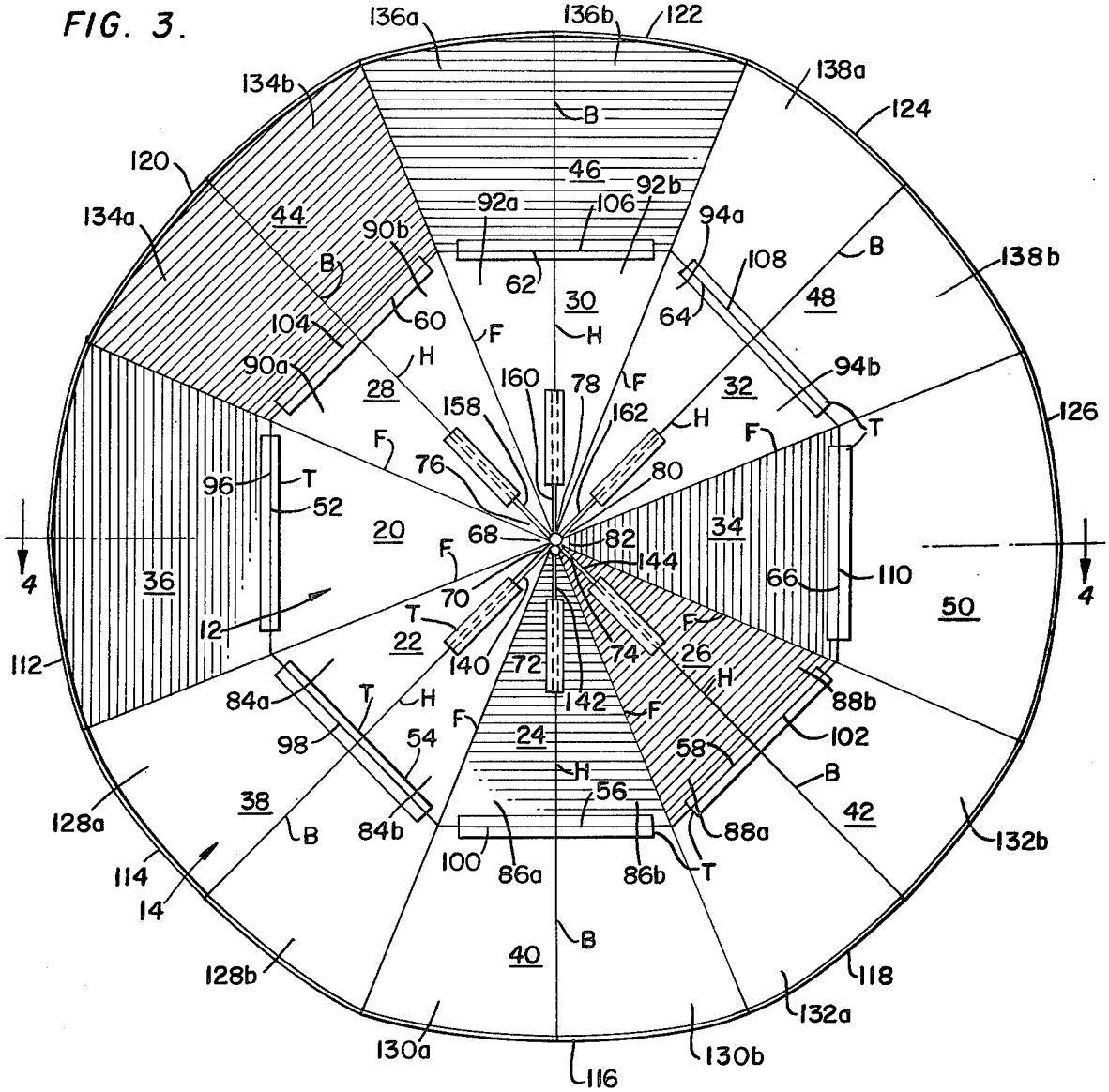
FIG. 3 is a bottom plan view of the umbrella illustrated in FIG. 1.
Figure 4:
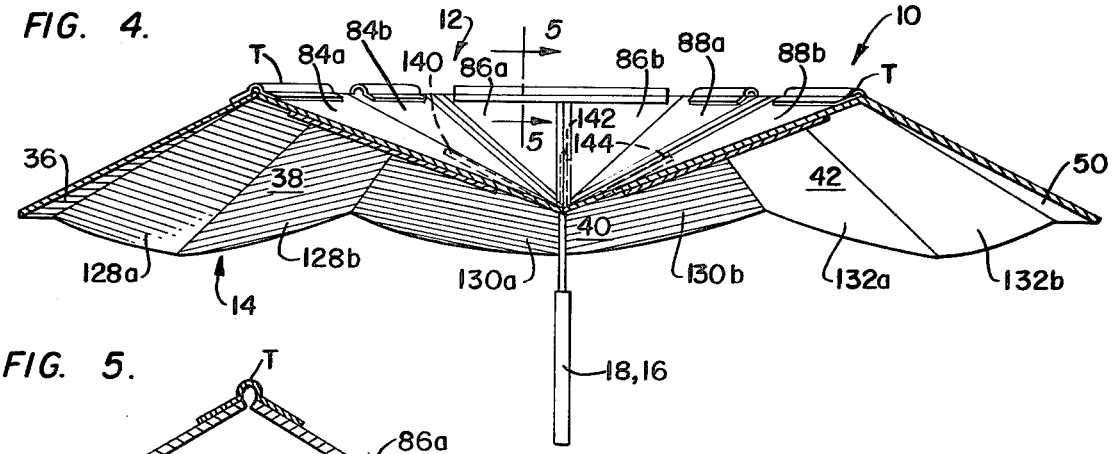
FIG. 4 is a sectional view of the umbrella according to the present invention taken along the plane of 4—4 in FIG. 3 and looking in the direction of the arrowheads.

Referring now to the drawings in detail, the reader will readily appreciate from FIGS. 1–4 and 6 that the subject matter of the present invention relates to a new and improved foldable umbrella 10 comprising four principal components assembled together, namely a central canopy component 12, a peripheral canopy component 14, and first and second operating units 16, 18, respectively. According to the invention, the umbrella 10 upon which a patent is applied for presently, it is constructed with paperboard of the corrugated, the pasteboard or other types which would be generally self-sustaining in form with little or no need for reinforcement.

To be readily foldable, umbrella 10 is formed in many panels foldably connected to each other along hinges or fold lines around which the various panels or sections may be turned, whereby the umbrella 10 may be folded to or unfolded from storage condition. With the umbrella 10 in erected condition as illustrated in FIGS. 1–4, the reader will readily appreciate that central canopy compartment 12 comprises a plurality of radially inwardly disposed panels 20, 22, 24, 26, 28, 30, 32 and 34 and that peripheral canopy component 14 comprises a like number of radially outwardly disposed panels 36, 38, 40, 42, 44, 46, 48 and 50. Also, as clearly illustrated, the radially inwardly disposed panels 20, 22, 24, 26, 28, 30 and 32 are all generally in the form of isosceles triangles arranged in side-by-side relationship with the respective bases 52, 54, 56, 58, 60, 62, 64 and 66 defining or forming a theoretical circumscribing circle and the opposite vertices 68, 70, 72, 74, 76, 78, 80 and 82 at the center of such circle. Of the radially inwardly disposed panels 20, 22, 24, 26, 28, 30, 32 and 34, one is regarded as a first main panel 20 and another is regarded as a second main panel 34 situated in diametrically opposed positions to each other. The other panels are oriented as a first series of secondary panels 22, 24, 26 extending in a clockwise direction from the first main panel 20 to the second main panel 34, and as a second series of secondary panels 28, 30, 32 extending in a counterclockwise direction from the first main panel 20 to the second main panel 34. The first and second main panels 20 and 34 are each foldably connected to adjacent ones of the secondary panels 22, 28 and 26, 32, respectively, on opposite sides thereof along radial fold lines F. Each of the secondary panels 22, 24, 26, 28, 30 and 32 are foldably connected to at least one secondary panel adjacent thereto along a radial fold line F and are further bisected into substantially right triangular sections 84*a*, 84*b*, 86*a*, 86*b*, 88*a*, 88*b*, 90*a*, 90*b*, 92*a*, 92*b*, 94*a*, 94*b* by a hinge H extending from a vertex 70, 72, 74, 76, 78 and 80 at the center of the center of the theoretical circle to the respective base 54, 56, 58, 60, 62, and 64 opposite therefrom. Each of the secondary panels 22, 24, 26, 28, 30 and 32 are foldable along the respective hinge H thereof whereby the substantially right triangular sections 84*a*, 84*b*, 86*a*, 86*b*, 88*a*, 88*b*, 90*a*, 90*b*, 92*a*, 92*b*, 94*a*, 94*b* may be brought together to close umbrella 10 while each of the secondary panels 22, 24, 26, 28, 30 and 32 further connected to at least one other of secondary panels 22, 24, 26, 28, 30 and 32 along a futher fold line F and simultaneously foldable thereat to close umbrella 10. The plurality of radially outwardly disposed panels 36, 38, 40, 42, 44, 46, 48 and 50 are generally trapezoidal in form, arranged in side-by-side relationship and have radially inwardly disposed minor bases 96, 98, 100, 102, 104, 106, 108 and 110 and radially outwardly disposed major based 112, 114, 116, 118, 120, 122, 124 and 126 respectively. One of the generally trapezoidal panels 36, 38, 40, 42, 44, 46, 48, 50 is regarded as a first main trapezoidal panel 36, another on of the trapezoidal panels 36, 38, 40, 42, 46, 48, 50 is regarded as a second main trapezoidal panel 50, the two are situated in positions diametrically opposed to each other. A first series of secondary trapezoidal panels 38, 40, 42 extend in a clockwise direction from the first main trapezoidal panel 36 to the second main trapezoidal panel 50, and a second series of secondary trapezoidal panels 44, 46, 48 extend in a counterclockwise direction from the first main trapezoidal panel 36 to the second trapezoidal panel 50. The first and second main trapezoidal panels 36 and 50 are foldably connected along the minor bases respective 96 and 110 thereof to the first and second main triangular panels 20 and 34 along the respective bases 52 and 66 of first and second main triangular panels 20 and 34. The secondary trapezoidal panels 38, 40, 42, 44, 46 and 48 are each foldably connected along the respective minor base 98, 100, 102, 104, 106 and 108 thereof to one of the secondary triangular panels 22, 24, 26, 28, 30 and 32 along the respective bases 54, 56, 58, 60, 62 and 64 of such secondary triangular panels 22, 24, 26, 28, 30 and 32. Deach of the secondary trapezoidal panels 38, 40, 42, 44, 46 and 48 are bisected into further generally trapezoidal sections 128*a*, 128*b*, 130*a*, 130*b*, 132*a*, 132*b*, 134*a*, 134*b*, 136*a*, 136*b*, 138*a* and 138*b* by a fold line B extending from the minor base 98, 100, 102, 104, 106 and 108 to the major base 114, 116, 118, 120, 122 and 124 thereof and extended generally from the respective vertex 70, 72, 74, 76, 78 and 80 of the radially inwardly disposed secondary triangular panel 22, 24, 26, 28 30 and 32 foldably connected thereto whereby the further trapezoidal sections 128*a*, 128*b*, 130*a*, 130*b*, 132*a*, 132*b*, 134*a*, 134*b*, 136*a* 136*b*, 138*a* and 138*b* may be brought together when the umbrella 10 is closed. The first and second main trapezoidal panels 36 and 50 are each connected on opposite sides thereof to adjacent ones of said secondary trapezoidal panels 38, 44 and 42, 48 respectively, and the secondary trapezoidal panels 38, 40, 42, 44 46 and 48 are further foldably connected to a least one other secondary trapezoidal panel 38, 40, 42, 44, 46 and 48.

Each of the operating units 16 and 18 is identical and arranged in mirror image to each other a assembled on umbrella 10 as may be appreciated in FIGS. 6 and 9–11. As con be readily seen in FIGS. 9 and 10 first operating unit 16 comprises support portions 140, 142, 144 and handle portions 146, 148, 150 extending from support portions 140, 142, 144 at right angles thereto at elbow portions 152, 154, 156. The support portions 140, 142, 144 can be seen in FIGS. 3, 4, 6 and 11 to be secured to the underside of the first series of secondary triangular panels 22, 24, 26, while the second operating unit 18 which comprises support portions 158, 160, 162 are secured to the underside of the second series of secondary triangular panels 30, 32, 34 and includes handle portions 164, 166, 168 extending at right angles therefrom at elbow portions 170, 172, 174 thereof. It may be further seen that each of the first and second operating units 16 and 18 is formed from a plurality of wire or like members each of which includes a segment of substantial length constituting the support portions 140, 142, 144, 158, 160, 162 extending along the underside of the umbrella 10, along one of the hinges H of one of the secondary triangular panels 22, 24, 26, 28, 30 32, such segments being secured to the secondary triangular panel 22, 24, 26, 28, 30, 32. Operating units 16 and 18 each includes second segements of substantial length integral with and extending from the first segments at right angles thereto and constitutes a part of one of the handle portions 146, 148, 150, 164, 166, 168 each of the second segments 146, 148, 150 of wire or like member of one operating units 16 is secured in generally side-by-side contacting relationship with other second segments 146, 148, 150 of wire or like members of the operating unit 16 formed thereby. The handle portions 146, 148, 150 are secured together by a tube or annular member as disclosed, but may also be taped together. Inasmuch as operating unit 18 as indicated above is identical in construction to operating unit 16, the second segments 164, 166, and 168 are also secured together in side-by side relationship. Support is thus provided to umbrella 10 with first segments 140, 142, 148 of said first operating unit 16 and first segments 158, 160, 162 second operating unit are secured to the underside of first and second secondary triangular panels 22, 24, 26, 28, 30, 32 respectively. From FIGS. 2, 4, and 9 it may be appreciated that handle portions 146, 148, 150 and 164, 166, 168 of both operating units 16 and 18 extend generally downwardly from the vertices 70, 72, 74, 76, 78, 80 of secondary panels 22, 24, 26, 28, 30, 32 when umbrella 10 is in erected condition for use.

Figure 13:
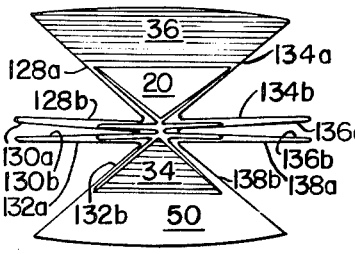
FIGS. 13–15 show bottom plan views of the umbrella according to the present invention progressively from initially open, to intermediate open, to fully open stages with portions broken away for lack of space in FIG. 15.
Figure 14:
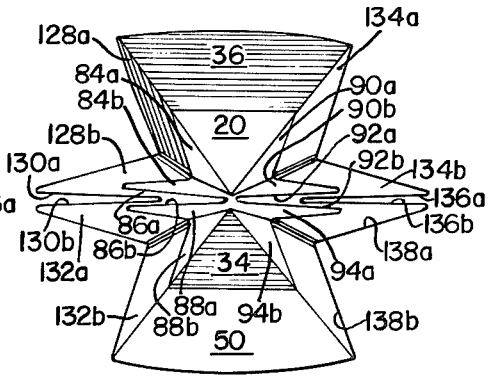
Figure 15:
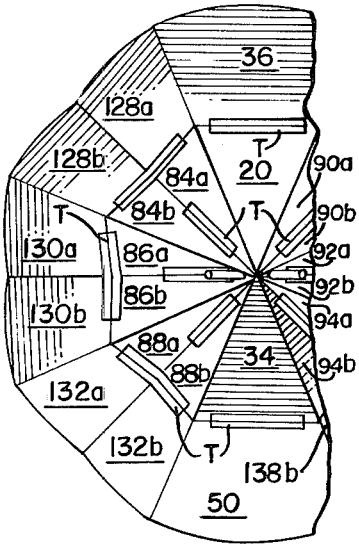

As may be appreciated from FIGS. 7, 8, 11, and 12 in collapsed storage condition of umbrella 10 the various panels 20, 22, 24, 26, 28, 30, 32, 34, 36, 38, 40, 42, 44, 46, 48, 50 thereof are in accordion-like relationship to each other with the two main trapezoidal panels 36 and 50 on the outside and in sandwich-like relationship to all of the other of said panels 20, 22, 24, 26, 28, 30, 32, 34, 38, 40, 42, 44, 46, 48. Also, as may be appreciated from FIGS. 13-15 considered together with FIGS. 7, 8, 11, and 12 each of the first and second main triangular panels 20 and 34 and each of the secondary triangular panels 22, 24, 26, 28, 30, 32 is folded downwardly between the first and second main trapezoidal panels 36 and 50 along its base 52, 66, 54, 56, 58, 60, 62, 64 along which it is connected to the minor base 96, 110, 98, 100, 102, 104, 106, 108 of the first and second amin trapezoidal panels 36, 50 and the secondary trapezoidal panels 38, 40, 42, 44, 46, 48 structurally associated therewith. Also, when umbrella 10 is collapsed each of the secondary trapezoidal panels 38, 40, 42, 44, 46, 48 is folded inwardly between main trapezoidal panels 36, 50 from opposite sides thereof and in half along the fold line B thereof and each of the secondary triangular panels 22, 24, 26, 28, 30, 32 is folded inwardly from opposite sides thereof and in half along the hinge H thereof with portions of both halves of each of the secondary triangular panels 22, 24, 26, 28, 30, 32. It may also be appreciated that as umbrella 10 is collapsed each of hinges H of the secondary triangular panels 22, 24, 26 of first series and each of hinges H of the secondary triangular panels 28, 30, 32 of second series are disposed inwardly adjacent to each other with the substantially right triangular sections **84*a*, 84*b*, 86*a*, 86*b*, 88*a* 88*b* first series lying over each other and between one half of each of first and second main triangular panels 20, 34 and the substantially right triangular sections 90*a*, 90*b*, 92*a*, 92*b*, 94*a*, 94*b* of second series lying over each other and between the other half of each of first and second main triangular panels 20, 34. Moreover, it may be appreciated that in collapsed storage condition of umbrella 10 and the various panels 20, 22, 24, 26, 28, 30, 32, 34, 36, 38, 40, 42, 44, 46, 48, 50 thereof the handle portions 146, 148, 150, 164, 166, 168 of the first and second operating units 16, 18 extend generally away from each of the respective elbow portions 152, 154, 156, 170, 172, 174** thereof.

Figure 5:
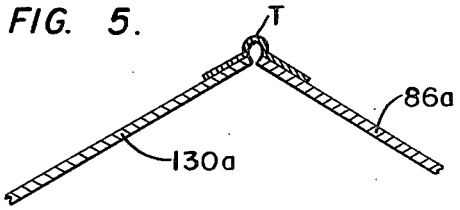
FIG. 5 is a sectional view taken along the plane of 5—5 in FIG. 4 and looking in the direction of the arrowheads.
Figure 6:
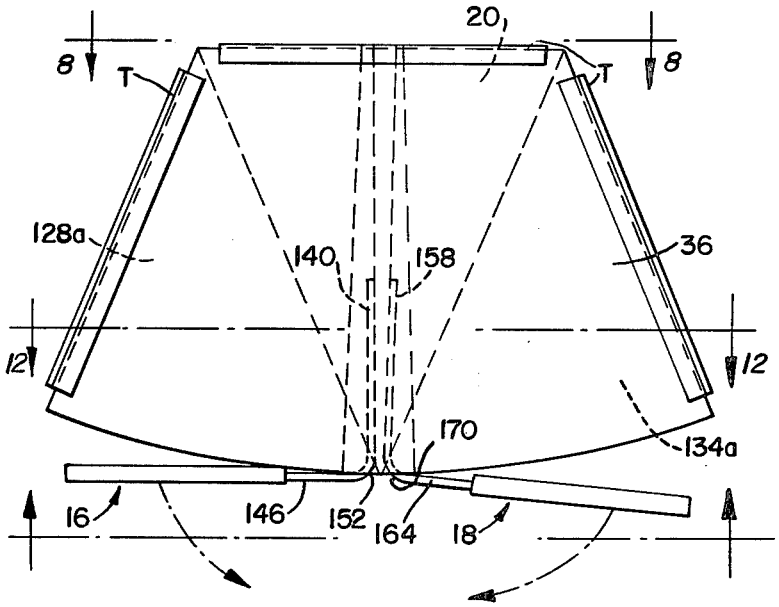
FIG. 6 is a side elevational view of the umbrella of FIG. 1 when it is in folded for storage condition.
Figure 7:
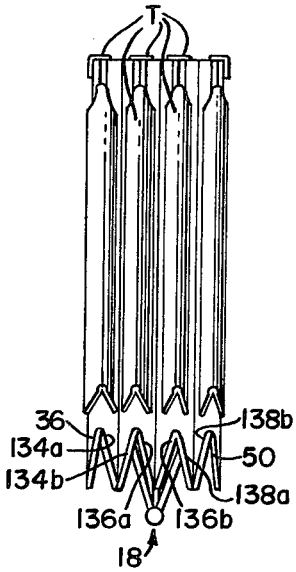
FIG. 7 is an end elevational view of the umbrella as folded and illustrated in FIG. 6.
Figure 8:
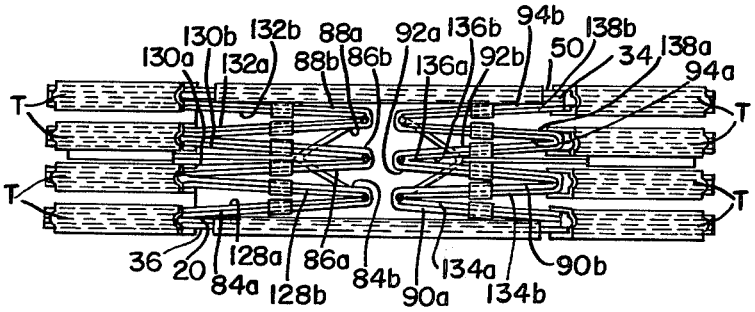
FIG. 8 is a sectional view taken along the plane of 8—8 in FIG. 6 and looking in the direction of the arrowheads.
Figure 9:
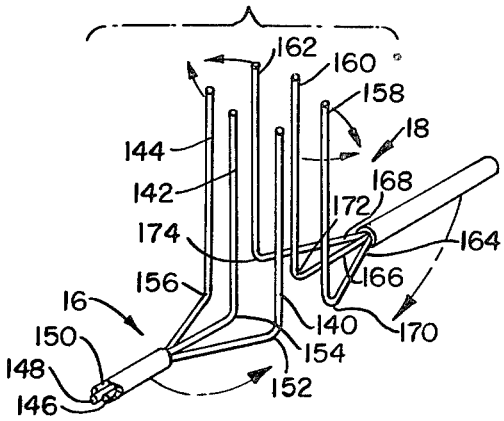
FIG. 9 is an elevational view in perspective of the operating handle units prior to assembly, but in the position that they would take when the umbrella is in folded condition as illustrated in FIG. 6.
Figure 10:
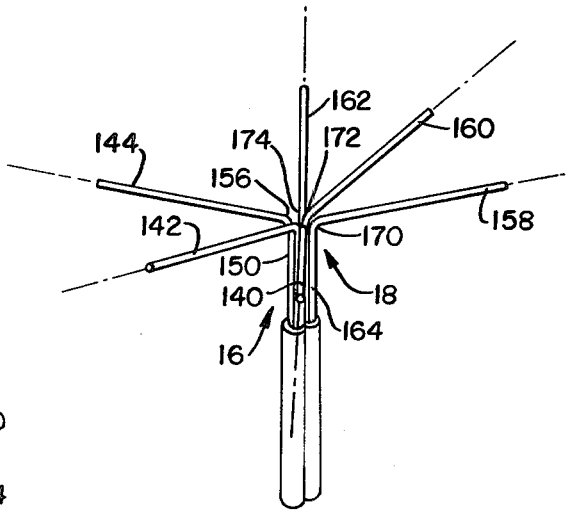
FIG. 10 is an elevational view in perspective of the operating handle units prior to assembly, but in the position that they would taken when the umbrella is in erected condition as illustrated in FIG. 2.
Figure 11:
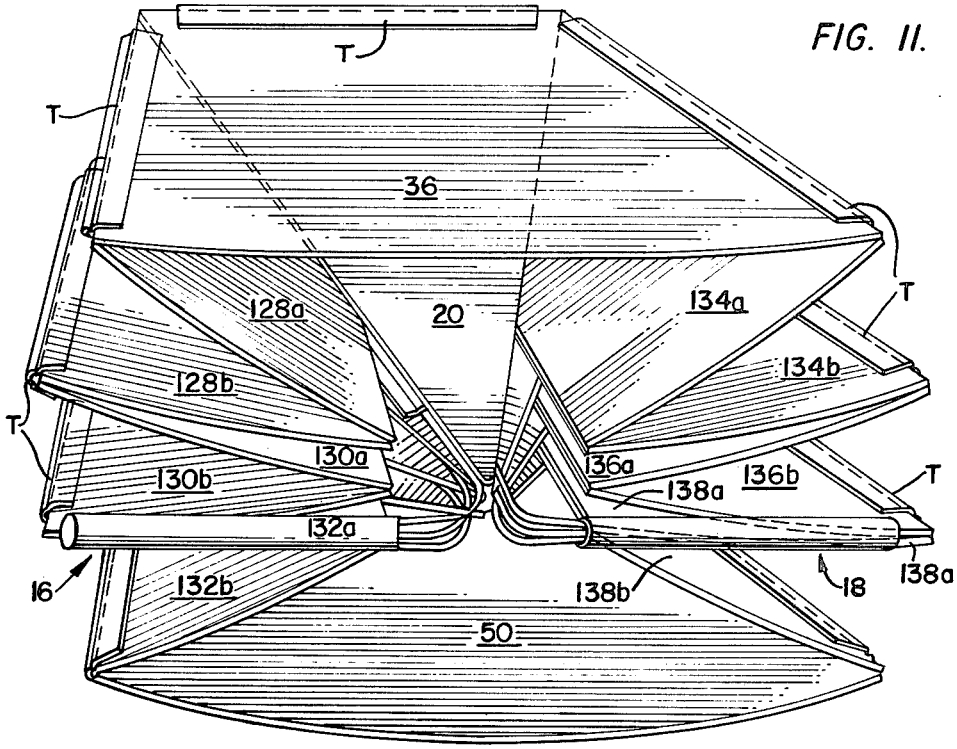
FIG. 11 is a view in perspective of the umbrella according to the present invention lying on one side in near-flat folded condition, but partially open at the lower side to expose relationship of the various parts therein.
Figure 12:
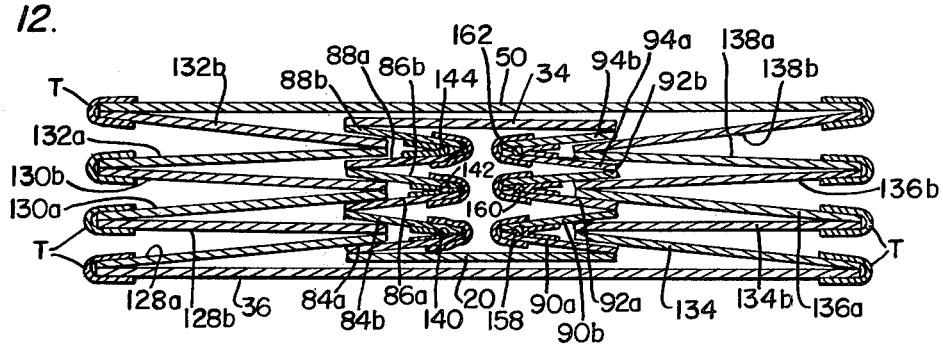
FIG. 12 is a sectional view taken along the plane of 12—12 in FIG. 6 and looking in the direction of the arrowheads.

Strips of tape T may be applied to various panels and/or sections to reinforce and/or secure same in assembled foldable relationship with each other as may be seen in FIGS. 1-4, 6-8, 11 and 12. Each strip of tape T is applied over adjacent portions of sections **86*a* and 130*a* or the like with some slack as may be seen in FIG. 5** above the apex formed by foldable portions in order to avoid stresses that otherwise would tend to pull such portions off from the strip if tape T if such portions are folded together between tape T without slack.

It will be obvious to those skilled in the art that various changes may be made without departing from the scope of the invention and the invention is not to be considered limited to what is shown in the drawings and described in the specification.

What is claimed is:

1. An umbrella of paper board or like material which in erected condition comprises in combination:

(a) a plurality of radially inwardly disposed panels;

(b) a plurality of radially outwardly disposed panels;

(c) a first operating unit; and (d) a second operating unit; wherein said radially inwardly disposed panels are all generally in the form of isosceles triangles arranged in side-by-side relationship with the bases forming a theorethical circumscribing circle and the opposite vertices at the center of such circle, said inwardly disposed panels include a first main panel and a second main panel situated in a position diametrically opposed to said first main panel, a first series of secondary panels extending in a clockwise direction from said first main panel to said second main panel, a second series of secondary panels extending in a counterclockwise direction from said first main panel to said second main panel, said first and second main panels each being foldably connected to adjacent ones of said secondary panels on opposite sides thereof, each of said secondary panels being bisected into substantially right triangular sections by a hinge extending from the vertex at the center of the center of the theorethical circle to the base opposite therefrom, each of said secondary panels being foldable along the respective hinge thereof whereby the substantially right triangular sections may be brought together to close said umbrella, each of said secondary panels further being foldably connected to at least one other of said secondary panels along a further fold line; said plurality of radially outwardly disposed panels being generally trapezoidal in form, arranged in side-by-side relationship and having radially inwardly disposed minor bases and radially outwardly disposed major bases, one of said generally trapezoidal panels being a first main trapezoidal panel, another one of said trapezoidal panels being a second main trapezoidal panel situated in a position diametrically opposed to said first main trapezoidal panel, a first series of secondary trapezoidal panels extending in a clockwise direction from said first main trapezoidal panel to said second main trapezoidal panel, a second series of secondary trapezoidal panels extending in a counterclockwise direction from said first main trapezoidal panel to said second trapezoidal panel, said first and second main trapezoidal panels being foldably connected along the minor bases thereof to said first and second main triangular panels along the respective bases of said first and second main triangular panels, said secondary trapezoidal panels each being foldably connected along the respective minor base thereof to one of said secondary triangular panels along the bases of such secondary triangular panels, each of said secondary trapezoidal panels being bisected into further trapezoidal sections by a fold line extending from the minor base to the major base thereof and extended generally from the vertex of the radially inwardly disposed secondary triangular panel foldably connected thereto whereby said further trapezoidal sections may be brought together when said umbrella is closed, said first and second main trapezoidal panels each being connected on opposite sides thereof to adjacent ones of said secondary trapezoidal panels, said secondary trapezoidal panels further being foldably connected to at least one other secondary trapezoidal panel; said first operating unit comprising support portions and handle portions extending from said support portions at right angles thereto at elbow portions, said support portions being secured to the underside of said first series of secondary triangular panels; and said second operating unit comprising support portions secured to the underside of said second series of secondary triangular panels and also having handle portions extending at right angles therefrom at elbow portions thereof.

2. An umbrella as defined in claim 1 wherein each of said first and second operating units comprise a plurality of wire or like members each of which includes a segment of substantial length extending along the underside of said umbrella, along one of said hinges of one of said secondary triangular panels, said segment being secured to the said secondary triangular panel and constituting a part of one of said support portions.

3. An umbrella as defined in claim 2 wherein each of said plurality of wire or like members includes a second segments of substantial length integral with and extending from said first segment at right angles thereto and constitutes a part of one of said handle portions.

4. An umbrella as defined in claim 3 wherein each of said second segment of wire or like member of one of said operating units is secured in generally side-by-side contacting relationship with said second segments of wire or like members of the operating unit formed thereby.

5. An umbrella as defined in claim 4 wherein said first segments of said first operating unit and said first segments of said second operating unit are secured to said underside of said first and said second secondary triangular panels, respectively.

6. An umbrella as defined in claim 5, wherein said handle portions of both said first and said second operating units extend generally downwardly from the vertices of said secondary panels when said umbrella is in erected condition for use.

7. An umbrella as defined in claim 2 wherein in collapsed storage condition the various panels thereof are in accordion-like relationship to each other with said two main trapezoidal panels being on the outside and in sandwich-like relationship to all other of said panels.

8. An umbrella as defined in claim 7 wherein each of said first and second main triangular panels and each of said secondary triangular panels is folded downwardly between said first and second main trapezoidal panels along its base along which it is connected to the minor base of said first and second main trapezoidal panels and the secondary trapezoidal panels structurally associated therewith.

9. An umbrella as defined in claim 8 wherein each of said secondary trapezoidal panels is folded inwardly from opposite sides thereof and in half along said fold line thereof and each of said secondary triangular panels is folded inwardly from opposite sides thereof and in half along said hinge thereof with portions of both halves of each of said secondary trapezoidal panels and the respective fold line thereof lying between portions of both halves of one of said secondary triangular panels.

10. An umbrella as defined in claim 9 wherein each of said hinges of the secondary triangular panels of said first series and each of said hinges of the secondary triangular panels of said second series are disposed inwardly adjacent to each other with the substantially right triangular sections of said first series lying over each other and between one half of each of said first and second main triangular panels and the substantially right triangular sections of said second series lying over each other and between the other half of each of said first and second main triangular panels.

11. An umbrella as defined in claim 7 wherein in collapsed storage condition of the various panels thereof said handle portions of said first and second operating units extend generally away from each of the respective elbow portions thereof.

* * * * *